United States Patent [19]

Nash et al.

[11] Patent Number: 4,901,527

[45] Date of Patent: Feb. 20, 1990

[54] LOW TURBULENCE FLAME HOLDER MOUNT

[75] Inventors: Dudley O. Nash; James R. Reigel, both of Cincinnati; Frederick J. Stine, Maineville, all of Ohio

[73] Assignee: General Electric Company, Cincinnati, Ohio

[21] Appl. No.: 156,876

[22] Filed: Feb. 18, 1988

[51] Int. Cl.[4] ..... F02K 3/10

[52] U.S. Cl. ..... 60/261; 60/749

[58] Field of Search ..... 60/261, 749

[56] References Cited

U.S. PATENT DOCUMENTS

| | | | |
|---|---|---|---|
| 2,726,511 | 12/1955 | Pitt | 60/749 |
| 2,963,857 | 12/1960 | Egbert et al. | 60/261 |
| 3,002,352 | 10/1961 | Helfrich et al. . | |
| 3,009,317 | 11/1961 | Meyer et al. | 60/261 |
| 3,056,261 | 10/1962 | Krabacher et al. . | |
| 3,151,453 | 10/1964 | Lefebvre et al. | 60/261 |
| 3,153,324 | 10/1964 | Meyer | 60/261 |
| 3,156,094 | 11/1964 | Nash et al. | 60/749 |
| 3,595,024 | 7/1971 | Kohler et al. | 60/261 |
| 3,670,501 | 6/1972 | Arand | 60/261 |
| 3,765,178 | 10/1973 | Hufnagel et al. | 60/261 |
| 3,931,707 | 1/1976 | Vdoviak . | |
| 3,999,378 | 12/1976 | Tatem, Jr. et al. | 60/749 |
| 4,064,691 | 12/1977 | Nash . | |
| 4,134,260 | 1/1979 | Lefebvre et al. | 60/261 |
| 4,185,458 | 1/1980 | Ernst | 60/261 |
| 4,259,839 | 4/1981 | Laboure et al. | 60/261 |
| 4,315,401 | 2/1982 | Beal et al. | 60/261 |
| 4,380,899 | 4/1983 | Davies et al. | 60/261 |
| 4,592,200 | 6/1986 | Benoist et al. | 60/261 |
| 4,594,851 | 6/1986 | Kushnick et al. | 60/261 |

*Primary Examiner*—Donald E. Stout

*Attorney, Agent, or Firm*—Jerome C. Squillaro; Steven J. Rosen

[57] ABSTRACT

A low turbulence, close-coupled mounting structure for a flame holder disposed in an afterburner section of a gas turbine engine is provided. The afterburner section has a plurality of angularly spaced, radially extending fuel injection nozzles, with a fairing surrounding each nozzle to form open ended heat shields about the nozzles. A flame holder having a first cross-sectional configuration is disposed in recessed portions formed in the fairings surrounding the nozzles. The cross-sectional configuration of the recessed portions is configured to substantially conform to a portion of the cross-section of the flame holder such that the flame holder is recessed into the fairings when mounted thereon, thus eliminating outward projections at the connection of the flame holder and fairings. The flame holders are secured in the recessed portions by pins extending through aligned apertures in the skirts of the flame holder.

41 Claims, 5 Drawing Sheets

LOW TURBULENCE FLAME HOLDER MOUNT

The invention herein was first conceived and/or reduced to practice under or in the course of Government Contract No. F33657-83-C-0281 with the Department of the Air Force.

BACKGROUND OF THE INVENTION

1. Field of the Invention

The present invention relates to flame holders disposed in an afterburner section of a gas turbine engine, and particularly to an improved close-coupled mount for securing the flame holder in the afterburner section of the engine.

2. Description of the Related Art

High performance jet aircraft engines often include reheat thrust augmentation as a means of substantially increasing the thrust produced by the engine for brief periods. This thrust augmentation is accomplished by injecting fuel into an after burner section, downstream of the turbine, and igniting the fuel in a combustion zone in the afterburner section to increase the exhaust gas temperature. This increase in temperature results in an increase in thrust as the hot products of combustion expand through the jet nozzle. In order to stabilize the combustion zone in the afterburner section, turbulence producing flame holders are positioned downstream of the fuel injectors.

A typical jet aircraft engine configuration is shown schematically in FIG. 1, and is referred to generally as 10. It includes a turbine engine section 12 generally defined by arrows A, and an afterburner section 14 generally defined by arrows B. The exhaust gas flow path through engine 10 is represented by arrows C. Afterburner section 14 is located downstream from turbine engine section 12 in the exhaust gas flow path. Afterburner section 14 typically includes a plurality of fuel injectors 16 extending radially inward from an outer casing 18 of afterburner section 14. Fuel injectors 16 are typically surrounded by fairings 20 which form heat shields about the fuel injectors. Flame holders 22 are positioned downstream of fuel injectors 16 in afterburner section 14 and are typically fastened to fuel injectors 20 by brackets 24.

In thrust augmentor or afterburner construction, it is desirable to control the combustion zone in the afterburner section. To this end exhaust gases and fuel pass over flame holders 22 and a turbulent wake which defines the combustion zone is created downstream from the flame holders. The fuel is vaporized by the hot gas stream exiting from turbine engine section 12, and the turbulent wake behind flame holders 22 creates a combustible mixture of exhaust gases and fuel for efficient burning.

In modern thrust augmentation exhaust gas temperatures are high enough that special precautions must be taken to avoid undesirable auto ignition of the fuel upstream of the flame holder at the fuel injectors. A key anti-auto ignition precaution involves injecting the fuel immediately upstream of the flame holder so that the fuel is not vaporized and mixed until it reaches the combustion zone in the turbulent wake behind the flame holder. This configuration is often referred to as close-coupled fuel injection, to which the present invention is directed.

In addition to close-coupled fuel injection, it is important that turbulence upstream of the flame holder be strictly limited or eliminated altogether since such turbulence produces conditions, i.e. sufficient mixing of the fuel and hot products of combustion, which tend to promote auto ignitition upstream of the combustion zone.

There are at least two additional drawbacks associated with prior art close-coupled flame holder attachments which have been hampering advanced thrust augmentor design during recent years. These additional problems relate to manufacture and maintenance of the flame holder.

With the emphasis strongly on maintainability in new jet engine designs, it is highly desirable, if not mandatory, that the flame holder be easily replaceable on the flight line by a mechanic entering the exhaust duct of the jet engine. Prior art attempts at providing close-coupled mounting of the flame holders to the fuel injectors have not optimized accessibility of flame holder attachments for easy maintenance while simultaneously providing sufficient heat resistance and turbulence reduction in the afterburner section.

Exhaust gas temperatures in modern jet engines have increased to the point that metallic flame holders have questionable life expectancy. To enhance the life expectancy of the flame holders ceramic technologies are being investigated and pursued in the search for an improved flame holder material. The design of such ceramic flame holders, however, has been hindered for many years by the manufacturing and brittleness limitations of ceramic.

Various proposals have been made for providing a flame holder mount which satisfies the needs of an advanced high temperature turbo jet engine. FIGS. 2A and 2B show some of the typical flame holder mounting configurations which have been utilized. Each of these prior art flame holder mount configurations utilize a bracket of various configurations such as 26 and 28 fastened to a fairing 20 which support flame holder 22. The outward projection of the brackets 26 and 28 from fairing 20 creates exhaust gas flow blockages and promotes turbulence upstream of flame holder 22. Such turbulence is undesirable since it is likely to cause local burning upstream of the combustion zone. The need to provide clearance in the attachment joints for fit-up of the flame holder with the supporting bracket and fairing adds directly to the aforesaid flow blockage and turbulence promotion and, thus, further increases the auto ignition risk.

As shown in FIG. 2A, pin 30 attaches bracket 26 to fairing 20; and in FIG. 2B, pin 32 attaches flame holder 22 to bracket 28, and pin 34 attaches bracket 28 to fairing 20. Each pin 30 and 34 projects outwardly with respect to fairing 20 thus causing undesirable flow blockages in the exhaust gas flow path upstream of the combustion zone. Moreover, pins 30, 32 and 34 are positioned upstream of flame holder 22 such that access from the rear or apex of the flame holder ring, as required for removal or installation of the flame holder, is difficult. Therefore, such designs require considerable maintenance man hours and/or special tools or fixtures for servicing.

As noted above, as far as is known, all prior art attempts for providing a close-coupled mounting structure for flame holder 22 include some type of bracket projecting from fairing 20. Such projections or brackets are difficult and costly to produce in the kind of ceramic and carbon composite materials that will tolerate the severe temperature and pressure conditions in advanced jet engines.

SUMMARY OF THE INVENTION

It is therefore an object of the present invention to provide a close-coupled mounting structure for a flame holder disposed in an afterburner section of a gas turbine engine which minimizes turbulence at the connection of the flame holder to the fairings upstream of the combustion zone.

It is a further object of the present invention to provide a close-coupled mounting structure for a flame holder disposed in an afterburner section of a gas turbine engine which is consistent with cost-effective ceramic, carbon composite or other high-temperature resistant material flame holder construction.

It is still a further object of the present invention to provide a close coupled mounting structure for a flame holder disposed in an afterburner section of a gas turbine engine which provides easy accessibility for removal and installation of the flame holder during maintenance and servicing.

Additional objects and advantages of the invention will be set forth in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects, and in accordance with the purposes of the invention as embodied and broadly described herein, there is provided a gas turbine engine having an after burner section for increasing the energy level of a hot gas stream flowing through the afterburner section. The after burner section comprises an outer casing, and a plurality of elongated fuel injectors extending radially inward from the outer casing and angularly spaced around the casing. A plurality of fairings, surrounding respective fuel injectors, are provided for forming open-ended heat shields about the fuel injectors. The afterburner section further includes at least one flame holder having a first predetermined cross-sectional configuration.

A first recessed portion is formed in the downstream side of each fairing. The first recessed portions each have a second cross-sectional configuration substantially corresponding to at least a portion of the first cross-sectional configuration of the flame holder for receiving the flame holder therein.

Means are provided, disposed within the fairing, for securing the flame holder in selected ones of the first recessed portions of the fairings. Flow blockage and turburlence promotion upstream of the combustion zone is thus minimized in the connection between the flame holder and the fairing by eliminating outwardly extending brackets or pins which had heretofore been used to mount the flame holder to the fairing.

The fairings surrounding respective fuel injectors preferably have a substantially elliptical outer contour with the smaller semiaxis of the elipse projecting transversely in the exhaust gas flow path so as to minimize drag in the exhaust gas flow path.

It is also preferable that the afterburner section comprise first fuel injectors and respective first fairings having a first length, and second fuel injectors and respective second fairings having a second length shorter than the first length. The first and second fuel injectors and fairings are alternately disposed around the outer casing of the afterburner section. The longer first fairings may then be configured with second recessed portions radially spaced from the first recessed portions for receiving a second fame holder therein.

It is further preferable that the first and second flame holders comprise respective substantially annular rings with a substantially V-shaped cross-sectional configuration having a gutter-contour, and that the apex of the flame holders in the first and second recessed portions face upstream in the afterburner section.

It is still further preferable that the means for securing the flame holders in respective recessed portions include pairs of aligned apertures in the respective skirts of the V-shaped flame holders, and that the pairs of aligned apertures be peripherally spaced around respective flame holders to correspond to respective first and second recessed portions in the fairings. A rod with a pin positioned at the distal end thereof is disposed within a respective fairing to position the pin in the aligned apertures to secure the flame holders in respective recessed portions, thus eliminating the requirement for projections such as brackets or fastener pins extending outside of the fairing.

It is still further preferable that the fairings include a heat shield portion and at least two radially spaced cover portions. The fuel injector extends within the heat shield portion, and the cover portions are attached to the downstream side of the heat shield portion to form the elliptical or airfoil shaped outer contour of the fairing. The cover portions have opposing edges that are spaced and configured to form each recessed portion of the fairing.

BRIEF DESCRIPTION OF THE DRAWINGS

The accompanying drawings, which are incorporated in and constitute a part of the specification, illustrate a preferred embodiment of the invention and, together with the general description given above and the detailed description of the preferred embodiment given below, serve to explain the principles of the invention.

DESCRIPTION OF THE PREFERRED EMBODIMENT

Figure 1:
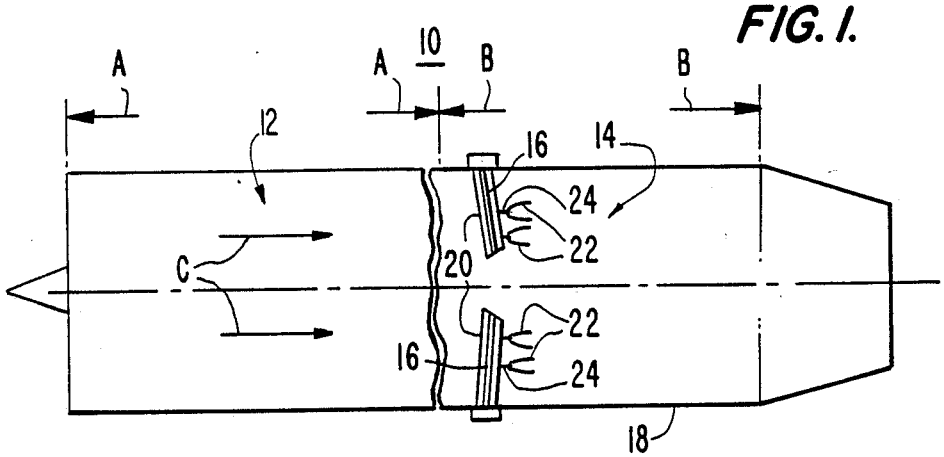
FIG. 1 is a schematic diagram of a typical turbo jet engine including a thrust augmentor comprised of an afterburner section with flame holder rings disposed therein.
Figure 2A:
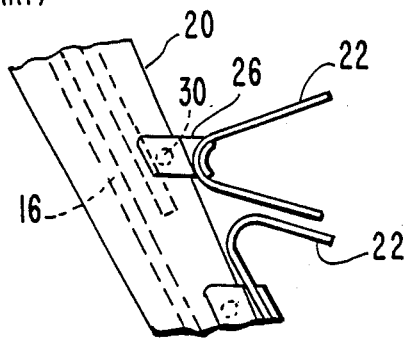
FIG. 2A. (PRIOR ART)
FIGS. 2A and 2B illustrate typical prior art close-coupled mounting structures for flame holders.
Figure 2B:
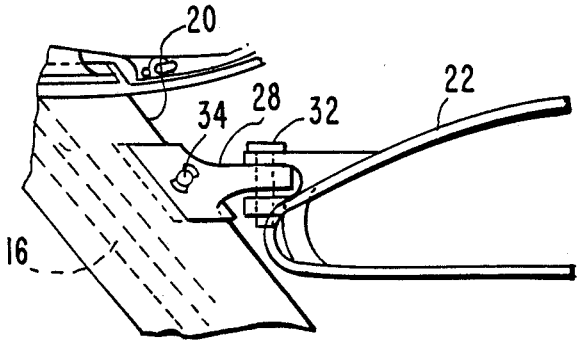
FIG. 2B. (PRIOR ART)

Reference will now be made in detail to the present preferred embodiment of the invention as illustrated in the accompanying drawings, wherein like reference numerals refer to like parts throughout the drawings.

Figure 3:
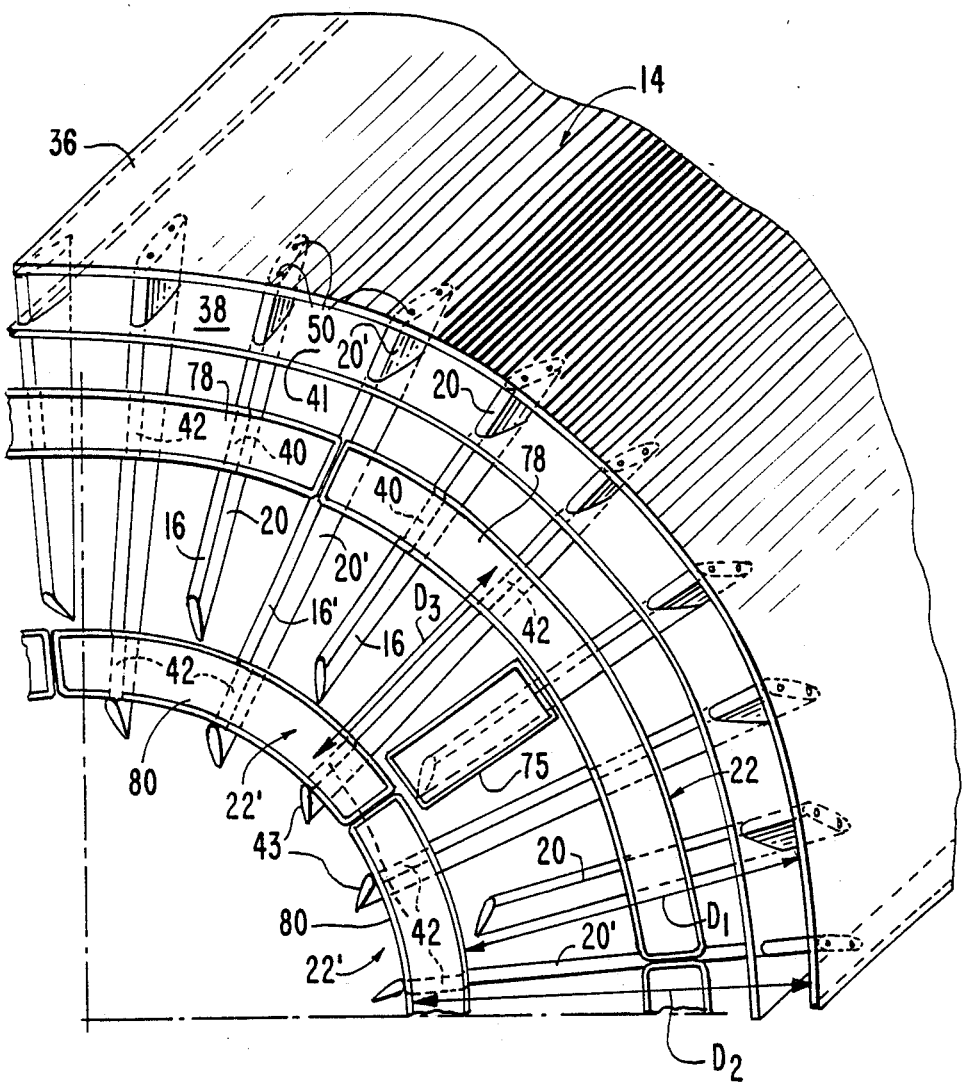
FIG. 3 is a partial isometric view of an afterburner section of a gas turbine engine incorporating the teachings of the present invention and illustrates concentric angular flame holder rings comprised of arcuate segments mounted on respective fairings.

The invention comprises a gas turbine engine having an after burner section for increasing the energy level of a hot gas stream flowing through the afterburner section. As shown in FIG. 3, an afterburner section broadly referred to as 14 includes an outer casing 36, an inner casing 38, first and second flame holders 22 and 22', and a plurality of elongated first and second fuel injectors 16 and 16' having respective first and second lengths D1 and D2. Fuel injectors 16 and 16' are alternately spaced around, and extend radially inward from, outer casing 36. First and second fairings 20 and 20', also having respective first and second lengths D1 and D2, extend radially from outer casing 36 and surround respective first and second fuel injectors 16 and 16' to form open ended heat shields about the fuel injectors. Each first and second fairing 20 and 20' has a first recessed portion 40 formed in the downstream side thereof, and each fairing 20' includes a second recessed portion 42, radially spaced from first recessed portion 40 by a distance D3, formed in the downstream side thereof. First and second flame holders 22 and 22' are then received in respective first and second recessed portions as will be described in more detail below.

Outer and inner casings 36 and 38 are spaced from each other to form an annular region 41. Typically, in a fan jet type engine, relatively cool fan air is blown through annular region 41 to cool outer casing 36 and inner casing 38.

Figure 4:
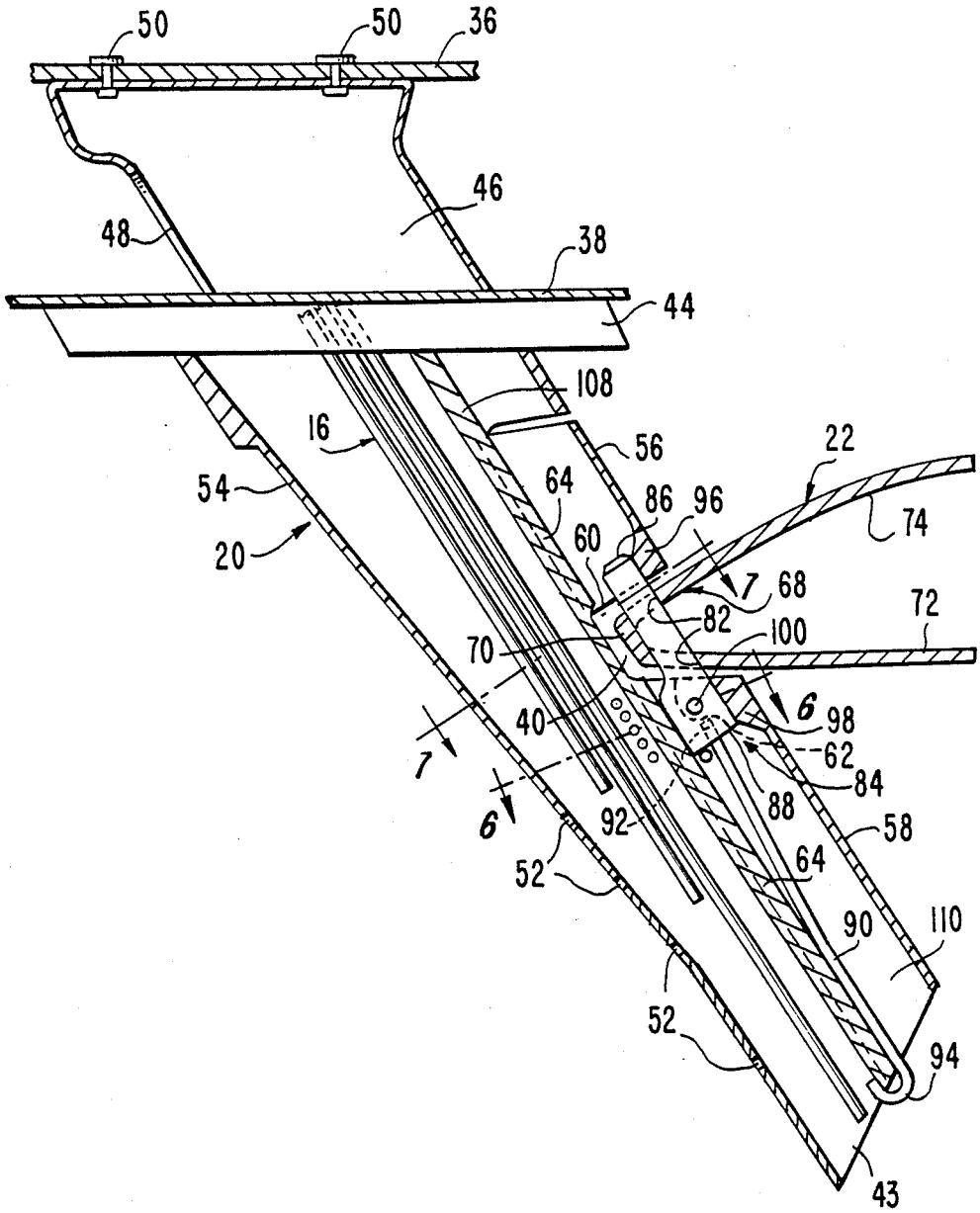
FIG. 4 is a partially cut-away side view of a close-coupled mount for a flame holder incorporating the teachings of the present invention with the pin disposed in the aligned apertures of the skirts of the flame holder.
Figure 5:
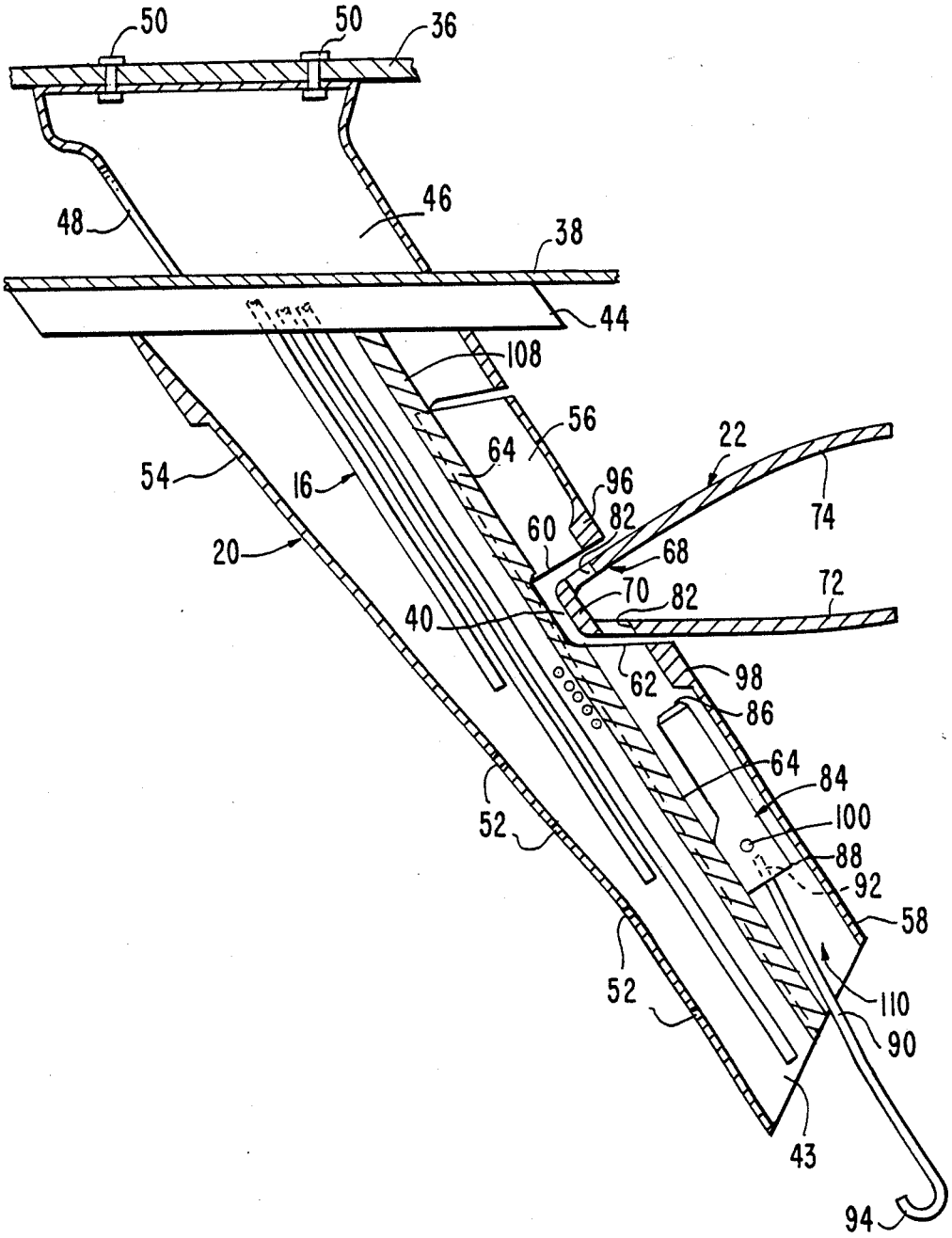
FIG. 5 is a partially cut-away side view of the close-coupled mount illustrated in FIG. 3 with the pin withdrawn from the aligned apertures of the skirts of the flame holder.

FIGS. 4 and 5 illustrate partially cutaway side views of a representative fairing 20 which illustrates a representative fuel injector 16 and a representative first recessed portion 40 in greater detail. Second fuel injectors 16' and second recessed portions 42 are formed similarly to the first fuel injectors and first fairings, and hence, the detailed discussion provided below will focus on the representative first recessed portion 40 and fairing 20.

Fuel injector 16 is preferably configured of a plurality of adjacent elongated nozzles which terminate sequentially radially inward in afterburner section 14. Fairing 20 surrounds fuel injector 16 and has an open end 43 at the innermost end thereof thus forming an open-ended heat shield about fuel injector 16. Fairing 20 preferably includes a flange portion 44 and a fastening portion 46 having a vertical opening 48 formed in the upstream side thereof. When disposed in afterburner section 14, fastening portion 46 of fairing 20 extends through inner casing 38 until flange portion 44 abuts inner casing 38. Fastening portion 46 of fairing 20 is attached to outer casing 36 of afterburner section 12 with captured self locking nuts 50 for example. Fairing 20 also includes a plurality of radially spaced apertures 52 on the side thereof.

To increase the energy level of the hot gas stream flowing through afterburner section 14, raw fuel is injected through the nozzles of fuel injector 16, and after passing through apertures 52 of fairing 20 is mixed with the hot gas stream exhausted from the turbine section and ignited to increase the temperature of the gas in the afterburner section.

Figure 6:
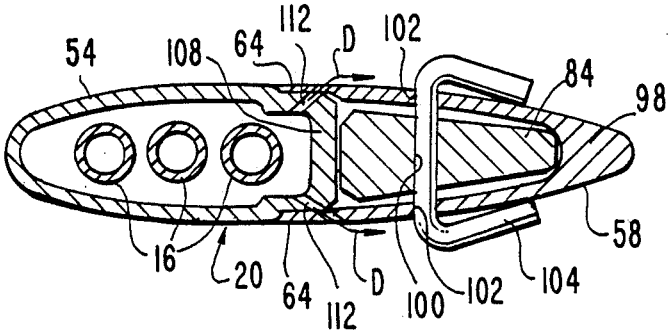
FIG. 6 is a cross-sectional view taken along line 6—6 of FIG. 4.
Figure 7:
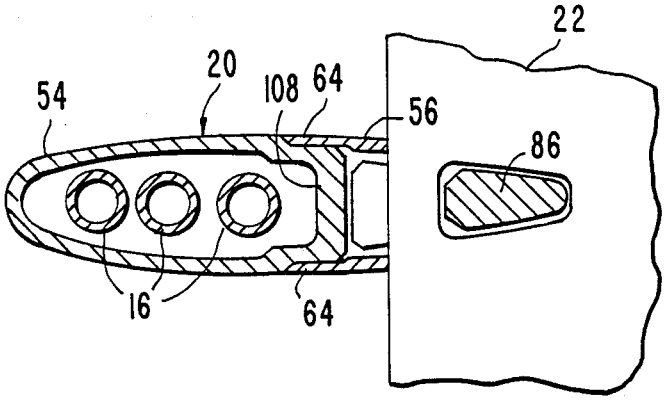
FIG. 7 is a cross-sectional view taken along the line 7—7 in FIG. 4.

Fairing 20 preferably has an elliptical or airfoil shaped outer contour, as seen in FIGS. 6 and 7, with the smaller semiaxis of the elipse projecting transversely in afterburner section 14 so as to minimize drag of the exhaust gases flowing through afterburner section 14.

In accordance with the invention, fairing 20 is preferably configured with a heat shield portion 54 and at least two cover portions 56 and 58 having respective edges 60 and 62. Cover portions 56 and 58 are attached to heat shield portion 54 on the downstream side thereof by any convenient means, such as brazing, at the overlapping portions 64 of heat shield portion 54 and cover portions 56 and 58. This configuration of heat shield portion 54 and cover portions 56 and 58 may be clearly seen in FIGS. 6 and 7. Edges 60 and 62 are radially spaced from each other and are configured to form first recessed portion 40 on the downstream side of fairing 20.

Although in the preferred embodiment of the invention as described above, first recessed portion 40 is formed by spacing edges 60 and 62 of cover portions 56 and 58 from one another when attached to heat shield portion 54, fairing 20 may also be constructed as a unitary structure with first recessed portion 40 comprising a cut-out section thereof.

In accordance with the invention, flame holder 22 is configured with a substantially V-shaped gutter contour type cross-sectional configuration having an apex 70, an inner skirt 72, and an outer skirt 74. First recessed portion 40 is also configured with a substantially V-shaped gutter contour cross-sectional configuration which corresponds to a portion 68 of the cross-sectional configuration of flame holder 22 close to apex 70. First recessed portion 40 is configured in fairing 20 such that the apex thereof faces upstream in afterburner section 14. Portion 68 of flame holder 22 is received in first recessed portion 40 with first recessed portion 40 fitting closely therearound.

With the configuration of first recessed portion 40 corresponding to portion 68 of the cross-sectional configuration of flame holder 22, flame holder 22 is received in first recessed portion 40 without the necessity of projections, such as brackets, extending outside of fairing 20. As previously discussed, it is necessary to stabilize combustion of the injected fuel in the turbulent wake produced behind flame holder 22. The configuration of flame holder 22 and first recessed portion 40, in combination, enhances stabilization of the combustion zone by eliminating projections in the connection thereof which create flow blockages in the exhaust gas path and promote undesirable auto ignition upstream of flame holder 22.

Although the cross-sectional configurations of first recessed portion 40 and flame holder 22 have been described above as a V-shaped gutter contour, the invention is not limited thereto, and any cross-sectional configuration of flame holder and recessed portion may be used which substantially correspond to each other so as to provide a close fit therebetween.

First fuel injectors 16, first flame holder 22, and first fairing 20 have been described above. Second fuel injectors 16', second flame holder 20', and second fairings 22' are configured similarly with the exception that second fuel injectors 16' and second fairings 22' are formed with a longer radial length D2 and with second recessed portions 42 radially spaced from the first recessed portion 40 in each second fairing. Second recessed portions 42 are configured with a cross-sectional configuration corresponding to at least a portion of the cross-sectional configuration of second flame holder 22' such that second flame holder 22' is received therein in the same manner that first flame holder 22 is received in first recessed portions 40. Thus, as can be seen in FIG. 3, two concentric annular flame holders are disposed in afterburner section 14 such that first flame holder 22 is received in first recessed portions 40 of each fairing 20 and 20', and second flame holder 22' is received in second recessed portions 42 of fairings 20'. It is further preferable that cross gutter portions 75 be disposed at spaced intervals around afterburner section 14 to connect first flame holder 22 and second flame holder 22' together to thereby provide flame propogation to second flame holder 22'.

The invention described herein is not limited to only two annular flame holders, and any number of flame holders may be disposed in afterburner section 14 by configuring third, fourth, etc. recessed portions in respective fairings at respective radial distances from outer casing 36, and disposing third, fourth, etc., flame holders therein.

Flame holders 22 and 22' are preferably formed of a plurality of respective arcuate segments 78 and 80. Arcuate segments 78 and 80, when secured in respective recessed portions 40 and 42, form substantially annular rings in afterburner section 14 with the ends of respective segments 78 and 80 being disposed opposite adjacent arcuate segments 78 and 80. By forming flame holders 22 and 22' of a plurality of respective arcuate segments 78 and 80, maintainability and repairability of the flame holders is enhanced since the individual segments are more easily handled during installation and removal in afterburner section 14. Moreover, should flame holders 22 and 22' become damaged, only the damaged segments need be replaced, further facilitating repairability.

Although flame holders 22 and 22' have been described above as preferably comprising a plurality of respective arcuate segments 78 and 80, the invention is not limited thereto and the flame holders may also be comprised of a substantially annular unitary structure which are received in respective first and second recessed portions 40 and 42.

In accordance with the present invention, there is also provided means for securing flame holders 22 and 22' in selected first and second recessed portions 40 and 42 of fairings 20 and 20'. For the sake of brevity, the securing means will be described hereinbelow for a representative flame holder 22 and representative first recessed portion 40. As embodied herein, and with reference to FIGS. 4 and 5, the securing means includes pairs of aligned apertures 82, formed in inner and outer skirts 72 and 74 of flame holder 22, and pin means, disposed in each pair of aligned apertures 82 and extending beyond each aperture into fairing 20, for holding flame holder 22 in first recessed portion 40.

As embodied herein, the pin means includes pin 84, having distal and proximate ends 86 and 88, respectively, which extend above and below first recessed portion 40 into fairing 20. Pin 84 is tapered outwardly from distal end 86 and each pair of aligned apertures 82 are dimensioned to engage the tapered portion of pin 84 when the pin is inserted in the apertures. Thus, radial movement of flame holder 22 relative to pin 84 is restricted, and flame holder 22 is tightly held on pin 84 and tightly secured in first recessed portions 40.

As further embodied herein, the securing means includes a rod 90. Rod 90 has a distal end 92 with pin 84 connected thereto. By way of example and not limitation, pin 84 may be connected to distal end 92 of rod 90 by welding, brazing, or alternatively, by mechanical retention. Rod 90 further includes a proximate end 94 configured as a hook.

Fairing 20 and flame holder 22 are typically constructed with relatively thin walls so as to minimize the weight of afterburner section 14 on the airframe housing the engine. Therefore, inner and outer skirts 72 and 74 preferably include locally thickened bearing portions formed about aligned apertures 82 to provide additional structural support to the flame holder in those areas where it bears against pin 84 when the exhaust gases are being ejected through the afterburner section. It is still further preferable that fairing 20 include locally thickened bearing portions 96 and 98 formed inside the fairing adjacent the edges of first recessed portion 40 for providing additional support to the fairing at the points where distal and proximate ends 86 and 88 of pin 84 bear against fairing 20. The absolute thickness of the bearing portions of flame holder 22 and fairing 20 is determined in accordance with the properties of the material comprising each, the force exerted on flame holder 22 by the momentum of the exhaust gases, and the design life expectancy of the components.

In accordance with the invention, and with reference to FIG. 6, the securing means further includes means for retaining pin 84 in aligned apertures 82. As embodied herein, the retaining means includes an aperture 100 in pin 84, and corresponding apertures 102 in fairing 20. The retaining means further includes a wire retainer 104 which is inserted through aperture 102 on one side of fairing 22, and extends through aperture 100 of pin 84 and then through the aperture 102 on the opposite side of fairing 22. Wire retainer 104 may then be bent down along the outside surface of fairing 22 so as not to introduce a transverse projection along the surface of fairing 22.

Retainer 104 is desirably heat resistant and constructed of a ductile material capable of being bent as required to conform the distal end portions thereof to the surface of fairing 22. The material thus selected must be highly heat resistant and have high ductility at room temperature. By way of example, platinum may be a suitable material, or alternatively a cobalt-based material, such as HS188, may be utilized. This cobalt-based material is sufficiently ductile at room temperature and has excellent wear resistance.

The embodiment of the retaining means described above provides the advantage of being easily accessible to maintenance personnel during installation or removal of the flame holder. Moreover, wire retainer 104 may be cut and quickly removed to facilitate mounting or dismounting of the flame holder in the recessed portions of the fairing.

In accordance with the invention, the close-coupled mounting structure further includes means for cooling the retaining means. As embodied herein and with reference to FIGS. 3, 5, and 6, the cooling means includes vertical opening 48 formed in fastening portion 46 of fairing 20. Vertical opening 48 communicates with the interior of fairing 20. The source of the cooling air injected into fairings 20 may come from any source of relatively cold air on the airframe which houses the engine incorporating the present invention. For instance, in a fan jet engine having an afterburner section, relatively cool fan air is moved through annular region 43 between outer casing 36 and inner casing 38 of afterburner 14. Fastening portion 46 of fairing 20 extends through annular region 43 between outer casing 36 and inner casing 38, and vertical opening 48 of fastening portion 46 may be configured to direct fan air from the annular region through the interior of fairing 20. The retaining means, which includes retaining pin 104, is cooled by directing cooling air through apertures 112 formed in fairing 20. Apertures 112 are configured to direct cooling air from the interior of fairing 20 onto retaining pins 104 as illustrated in FIG. 6 by arrows D.

In the present embodiment of the invention, as shown in FIG. 3, it is preferrable that each segment 78 and 80 of respective flame holders 22 and 22' be determinantly mounted at three mounting points 106 by securing means disposed in three respective recessed portions 40 or 42 so that no forcing or excessive loading of the material comprising the flame holder will exist due to dimensional variations of flame holders 22 and 22', or the supporting fairings 20 and 20', with the wide temperature variations which exist in a turbine engine afterburner section. However, it will be appreciated by those skilled in the art that securing means may be disposed in any selected number of recessed portions 40 and 42 which receive a respective segment 78 and 80, and the present invention is not limited to the three-point mounting configuration described above.

With reference to FIGS. 4, 6 and 7, fairing 20 is preferably provided with a cross member 108 extending through the interior thereof. In the preferred embodiment cross member 108 comprises an integral interior wall of heat shield portion 54. However, cross member 108 may also comprise a separate member attached to the interior of fairing 20 by brazing or welding for example. Cross member 108 thus defines a guide slot 110, spaced from fuel injector 16, for directing pin 84 into aligned apertures 82 of flame holder skirts 72 and 74. Guide slot 110 aids in the maintainability and repairability of the close-coupled mounting structure of the present invention since maintenance personnel may easily insert pin 84 in aligned apertures 82 by inserting rod 90 through open end 43 of fairing 20, and pushing the rod through guide slot 110 until hook portion 94 of rod 90 engages with the innermost end of cross member 108. The length of rod 90 is chosen such that when hook portion 94 engages cross member 108, pin 84 is seated in aligned apertures 82. In this manner, hook portion 94 of rod 90 provides a position limit stop and handling grip for insertion and withdrawal of the pin 84 through open end 42 of fairing 20 and aligned apertures 82 of flame holder skirts 72 and 74.

It is readily conceivable that other flame holder materials may be developed which do not suffer the limitations of ceramic materials with respect to machineability. For example, carbon based composites and metals exhibiting increased heat resistance may be used to form continuous ring flame holders which may be preferable in some applications.

Additional advantages and modifications will readily occur to those skilled in the art. The invention in its broader aspects is, therefore, not limited to the specific details representative apparatus an illustrative example shown and described. Accordingly, departures may be made from such details without departing from the spirit or scope of applicants general inventive concept.

What is claimed is:

1. A gas turbine engine afterburner section, comprising:

a plurality of radially inwardly extending fuel injectors surrounded by fairings;

at least one flame holder having a first cross-sectional configuration;

said fairings having a first recessed portion formed therein, said first recessed portions having a second cross-sectional configuration substantially corresponding to a portion of said first cross-sectional configuration of said flame holder for receiving said flame holder therein; and means for releasably securing said flame holder in selected ones of said first recessed portions of said fairings.

2. The gas turbine engine afterburner section of claim 1, wherein said first recessed portions are formed in the downstream side of said fairings.

3. The gas turbine engine afterburner section of claim 2, wherein each said fairing has a substantially elliptical airfoil-type shaped outer contour and includes a heat shield portion, and at least two cover portions attached on the downstream side of said heat shield portion, said at least two cover portions being radially spaced from each other with the edges thereof defining said first recessed portion in the downstream side of each fairing.

4. The gas turbine engine afterburner section of claim 1, wherein said first cross-sectional configuration of said flame holder and said second cross-sectional configurational configuration of said first recessed portions comprise a substantially V-shaped gutter contour, with the apex thereof facing upstream in said after burner section.

5. The gas turbine engine afterburner section of claim 4, wherein said afterburner section includes an outer casing from which said fuel injectors extend radially inward, said first recessed portions being spaced a first distance from said outer casing, and said flame holder being comprised of a predetermined number of arcuate segments, said arcuate segments forming a substantially annular structure when secured in respective first recessed portions.

6. The gas turbine engine afterburner section of claim 4, wherein said flame holder is comprised of a ceramic material.

7. The gas turbine engine afterburner section of claim 4, wherein said flame holder includes inner and outer skirts extending from said apex, and said securing means includes pairs of aligned apertures in said inner and outer skirts corresponding to said selected ones of said first recessed portions of said fairings; and said securing means includes pin means, extending through each said pair of aligned apertures of said flame holder skirts, for holding said flame holder in said first recessed portions.

8. The gas turbine engine afterburner section of claim 7, wherein said securing means includes means for retaining said pin means in each said pair of aligned apertures of said flame holder skirts.

9. The gas turbine engine afterburner section of claim 7, wherein said flame holder skirts include locally thickened reinforcing portions surrounding each said aligned aperture for supporting said flame holder on said pin means.

10. The gas turbine engine afterburner section of claim 8, wherein said securing means includes a rod, and said pin means includes a pin positioned at a distal end of said rod, said rod being disposed within a respective fairing to position said pin in corresponding pairs of aligned apertures of said flame holder skirts, and;

said retaining means includes an aperture in said pin and corresponding apertures in said fairing, and a wire retainer extending through said aperture of said pin and said apertures of said fairing to retain said pin in said aligned apertures of said flame holder skirts.

11. The gas turbine engine afterburner section of claim 10, wherein said pin includes distal and proximate ends extending from respective aligned apertures of said inner and outer skirts of said flame holder when said pin is disposed in said aligned apertures, and said fairing includes locally thickened bearing portions positioned within said fairing adjacent the edges of said first recessed portions for bearing against said distal and proximate ends of said pin to support said flame holder in said first recessed portion.

12. The gas turbine engine afterburner section of claim 10, including means for cooling said retaining means.

13. The gas turbine engine afterburner section of claim 12, wherein said cooling means includes means for injecting cool air through the interior of said fairing, and apertures in said fairing positioned proximate said wire retainer for directing said cool air from the interior of said fairing onto said wire retainer.

14. The gas turbine engine afterburner section of claim 10, wherein said rod includes a hook portion configured on the proximate end thereof, said hook portion being engageable with the open end of said fairing to provide a position limit stop and handling grip for insertion and withdrawal of said pin means through said open end of said fairing and said aligned apertures of said flame holder skirts.

15. The gas turbine engine afterburner section of claim 1, wherein said fuel injectors and said fairings comprise first fuel injectors and respective first fairings having a first length and second fuel injectors and respective second fairings having a second length longer than said first length, said first recessed portions of said first and second fairings being spaced a first distance from the outermost end of said fairings, and including:

a second flame holder having a second cross-sectional configurational configuration;

second recessed portions formed in said second fairings and radially spaced from said first recessed portions of said second fairings, said second recessed portions having a cross-sectional configuration substantially corresponding to a portion of said cross-sectional configuration of said second flame holder; and means for securing said second flame holder in selected ones of said second recessed portions.

16. The gas turbine engine afterburner section of claim 15, wherein said first and second fuel injectors and fairings are alternately spaced around said afterburner section.

17. The gas turbine engine afterburner section of claim 10, wherein said pin of said pin means includes a shank tapered outwardly from the distal end of the shank, and each said pair of aligned apertures of said flame holder skirts are dimensioned to engage said shank to restrict radial movement of said flame holder relative said shank.

18. The gas turbine engine afterburner section of claim 10, wherein each said fairing includes an elongated cross member extending through the interior of said fairing for defining a guide slot, spaced from the nozzle, for directing said pin into said pair of aligned apertures of said flame holder skirts.

19. The gas turbine engine afterburner section of claim 15, wherein said flame holder and said first recessed portions have a substantially V-shaped cross-sectional configuration with a gutter contour, with the apex thereof facing an upstream direction in said after burner section.

20. The gas turbine engine afterburner section of claim 19, wherein said first recessed portions are formed in the downstream side of said fairings.

21. The gas turbine engine afterburner section of claim 20, wherein said fairing has a substantially elliptical airfoil-type outer contour and includes a heat shield portion, and at least two airfoil type contour and includes a heat shield portion, and at least two cover portions attached on the downstream side of said heat shield portion, said at least two cover portions being radially spaced from each other with the edges thereof defining said first recessed portion in the downstream side of each fairing.

22. The gas turbine engine afterburner section of claim 19, wherein said afterburner section includes an outer casing from which said fuel injectors extend radially inward and said first recessed portions are spaced a first distance from said outer casing, and said flame holder is comprised of a predetermined number of arcuate segments, said arcuate segments forming a substantially annular structure when secured in respective first recessed portions.

23. The gas turbine engine afterburner section of claim 19, wherein said flame holder includes inner and outer skirts extending from said apex, and said mounting means includes pairs of aligned apertures in said inner and outer skirts corresponding to said first recessed portions of said fairings; and said securing means includes pin means, extending through each said pair of aligned apertures, for holding said flame holder in said first recessed portions.

24. The gas turbine engine afterburner section of claim 23, wherein said securing means includes means for retaining said pin means in each said pair of aligned apertures of said flame holder skirts.

25. The gas turbine engine afterburner section of claim 24, wherein said securing means includes a rod, and said pin means includes a pin disposed at a distal end of said rod, said rod being disposed within said fairing to position said pin in corresponding pairs of aligned apertures of said flame holder skirts; and said retaining means includes an aperture in said pin and corresponding apertures in said fairing, and a wire retainer extending through said aperture of said pin and said apertures of said fairing to retain said pin in said aligned apertures of said flame holder skirts.

26. The gas turbine engine afterburner section of claim 25, wherein said rod includes a hook portion configured on the proximate end thereof, said hook portion being engageable with the open end of said fairing to provide a position limit stop and handling grip for insertion and withdrawal of said pin means through said open end of said fairing and said aligned apertures of said skirts of said flame holder.

27. The gas turbine engine afterburner section of claim 25, wherein said pin of said pin means includes a shank tapered outwardly from the distal end of the shank, each said pair of aligned apertures of said flame holder skirts being dimensioned to engage said shank to restrict radial movement of said flame holder relative said shank.

28. The gas turbine engine afterburner section of claim 25, wherein each said fairing includes an elongated cross member extending through the interior of said fairing for defining a guide slot, spaced from the nozzle, for directing said pin into said pair of aligned apertures of said flame holder skirts.

29. A low turbulence, close-coupled mounting structure for a flame holder disposed in an afterburner section of a gas turbine engine, said afterburner section having a plurality of angularly spaced, radially extending fuel injection nozzles surrounded by fairings; said mounting structure comprising:

a first recessed portion formed in each said fairing;

said flame holder having a first cross-sectional configuration and said first recessed portions having a second cross-sectional configuration substantially corresponding to a portion of said first cross-sectional configuration of said flame holder;

means for releasably securing said flame holder is selected ones of said first recessed portions of said fairings.

30. The mounting structure of claim 29, wherein said fuel injectors and said fairings comprise first fuel injectors and respective first fairings having a first length, and second fuel injectors and respective second fairings having a second length longer than said first length, said first recessed portions of said first and second fairings being spaced a first distance from the outermost end of said fairings, including:

a second flame holder having a second cross-sectional configuration;

second recessed portions formed in said second fairings at a second distance radially spaced from said first recessed portions of said second fairings, said second recessed portions having a cross-sectional configuration substantially corresponding to a portion of said cross-sectional configuration of said second flame holder; and means for securing said second flame holder in selected ones of said second recessed portions.

31. The mounting structure of claim 30, wherein said first and second fuel injectors and fairings are alternately spaced around said afterburner section.

32. In an afterburner section of a gas turbine engine having radially inwardly extending fuel injectors surrounded by fairings, a means for attaching a flame holder to said fairings, comprising:

recessed portions formed in said fairings, said recessed portions being configured to receive at least a portion of said flame holder therein; and means for releasably securing said flame holder in selected ones of said recessed portions.

33. A gas turbine engine having an afterburner section for increasing the energy level of a hot gas stream flowing through said afterburner section, said afterburner section including:

an outer casing;

a plurality of first and second elongated fuel injectors extending radially inward from said outer casing and spaced alternately around said casing;

first and second fairings surrounding respective ones of said first and second fuel injectors for forming open ended heat shields about respective fuel injectors, said first fairings having a first length and said second fairings having a second length longer than said first length;

a first substantially annular V-shaped flame holder having a gutter contour, a first cross-sectional configuration, and a first radius, and a second substantially annular V-shaped flame holder having a gutter contour, a second cross-sectional configuration, and a second radius, said second radius being smaller than said first radius;

said first and second fairings having a first recessed portion formed therein at a first distance from said outer casing, said first recessed portions having a cross-sectional configuration substantially corresponding to a portion of said first cross-sectional configuration of said first flame holder, for receiving said first flame holder therein;

said second fairings further including a second recessed portion formed therein at a second distance from said outer casing greater than said first distance, said second recessed portions having a cross-sectional configuration substantially corresponding to a portion of said second cross-sectional configuration of said second flame holder, for receiving said second flame holder therein; and means for securing said first flame holder in said first recessed portions of said second fairings, and for securing said second flame holder in said second recessed portions of said second fairings, each said first and second flame holder having an apex facing upstream in said afterburner section, and inner and outer skirts extending from said apex; and said securing means including pairs of aligned apertures in said inner and outer skirts of said first and second flame holders corresponding to respective first and second recessed portions of said fairings, said securing means further including a rod, and a pin disposed on a distal end of said rod, said rod being disposed in said selected ones of said fairings to position said pin in said pair of aligned apertures of said flame holder skirts to hold said first and second flame holders in respective first and second recessed portions.

34. A gas turbine engine afterburner section, comprising:

a plurality of radially inwardly extending fuel injectors surrounded by fairings;

at least one flame holder having a first cross-sectional configuration;

said fairings having a first recessed portion formed in the downstream side of said fairings, said first recessed portions having a second cross-sectional configuration substantially corresponding to a portion of said first cross-sectional configuration of said flame holder for receiving said flame holder therein;

said fairing having a substantially elliptical airfoil-type shaped outer contour and includes a heat shield portion, and at least two cover portions attached on the downstream side of said heat shield portion, said at least two cover portions being radially spaced from each other with the edges thereof defining said first recessed portion in the downstream side of each fairing;

and means for securing said flame holder in selected ones of said first recessed portions of said fairings.

35. A gas turbine engine afterburner section, comprising:

a plurality of radially inwardly extending fuel injectors surrounded by fairings;

at least one flame holder having a first cross-sectional configuration;

said fairings having a first recessed portion formed therein, said first recessed portions having a second cross-sectional configuration substantially corresponding to a portion of said first cross-sectional configuration of said flame holder for receiving said flame holder therein;

said first cross-sectional configuration of said flame holder and said second cross-sectional configurational configuration of said first recessed portions comprise a substantially V-shaped gutter contour, with the apex thereof facing upstream in said after burner section;

said flame holder having inner and outer skirts extending from said apex, and said securing means includes pairs of aligned apertures in said inner and outer skirts corresponding to said selected ones of said first recessed portions of said fairings; and said securing means includes pin means, extending through each said pair of aligned apertures of said flame holder skirts, for holding said flame holder in said first recessed portions;

and means for securing said flame holder in selected ones of said first recessed portions of said fairings.

36. A gas turbine engine afterburner section, comprising:

a plurality of radially inwardly extending fuel injectors surrounded by fairings;

at least one flame holder having a first cross-sectional configuration;

said fairings having a first recessed portion formed therein, said first recessed portions having a second cross-sectional configurations substantially corresponding to a portion of said first cross-sectional configuration of said flame holder for receiving said flame holder therein;

said fuel injectors and said fairings comprising first fuel injectors and respective first fairings having a first length and second fuel injectors and respective second fairings having a second length longer than said first length, said first recessed portions of said first and second fairings being spaced a first distance from the outermost end of said fairings, and including:

a second flame holder having a second cross-sectional configurational configuration;

second recessed portions formed in said second fairings and radially spaced from said first recessed portions of said second fairings, said second recessed portions having a cross-sectional configuration substantially corresponding to a portion of said cross-sectional configuration of said second flame holder; and means for securing said second flame holder in selected ones of said second recessed portions;

and means for securing said flame holder in selected ones of said first recessed portions of said fairings.

37. The gas turbine engine afterburner section of claim 36, wherein said first and second fuel injectors and fairings are alternately spaced around said afterburner section.

38. The gas turbine engine afterburner section of claim 36, wherein said flame holder and said first recessed portions have a substantially v-shaped cross-sectional configuration with a gutter contour, with the apex thereof facing an upstream direction in said after burner section.

39. The gas turbine engine afterburner section of claim 38, wherein said first recessed portions are formed in the downstream side of said fairings.

40. The gas turbine engine afterburner section of claim 39, wherein said fairing has a substantially elliptical airfoil-type outer contour and includes a heat shield portion, and at least two airfoil type contour and includes a heat shield portion, and at least two cover portions attached on the downstream side of said heat shield portion, said at least two cover portions being radially spaced from each other with the edges thereof defining said first recessed portion in the downstream side of each fairing.

41. The gas turbine engine afterburner section of claim 38, wherein said afterburner section includes an outer casing from which said fuel injectors extend radially inward and said first recessed portions are spaced a first distance from said outer casing, and said flame holder is comprised of a predetermined number of arcuate segments, said arcuate segments forming a substantially annular structure when secured in respective first recessed portions.

* * * * *